United States Patent [19]

Noerskau et al.

[11] Patent Number: 4,976,106

[45] Date of Patent: Dec. 11, 1990

[54] LOAD-SENSING VARIABLE DISPLACEMENT PUMP CONTROLLER WITH ADJUSTABLE PRESSURE-COMPENSATED FLOW CONTROL VALVE IN FEEDBACK PATH

[75] Inventors: Juergen Noerskau, Lohr; Georg Klingenbeck, Klingenberg, both of Fed. Rep. of Germany

[73] Assignee: Linde Aktiengesellschaft, Fed. Rep. of Germany

[21] Appl. No.: 310,787

[22] Filed: Feb. 13, 1989

[30] Foreign Application Priority Data

Feb. 18, 1988 [DE] Fed. Rep. of Germany ..... 3805061

[51] Int. Cl.[5] ..... F15B 11/02; F15B 11/16; F04B 1/08

[52] U.S. Cl. ..... 60/452; 60/445; 60/450

[58] Field of Search ..... 60/445, 450, 452, 420, 60/427, 443; 91/506; 417/222

[56] References Cited

U.S. PATENT DOCUMENTS

| | | | |
|---|---|---|---|
| 3,856,436 | 12/1974 | Lonnemo | 60/450 X |
| 3,987,626 | 10/1976 | Bianchetta | 60/452 X |
| 4,087,968 | 5/1978 | Bianchetta | 60/452 X |
| 4,132,072 | 1/1979 | Schinkle | 60/445 X |
| 4,199,942 | 4/1980 | Kasper | 60/452 X |
| 4,355,510 | 10/1982 | Ruseff | 60/452 |
| 4,523,430 | 6/1985 | Masuda | 60/452 X |
| 4,553,904 | 11/1985 | Ruseff et al. | 60/452 X |
| 4,617,798 | 10/1986 | Krusche et al. | 60/450 |
| 4,617,854 | 10/1986 | Kropp | 91/517 |
| 4,665,699 | 5/1987 | Krusche | 60/452 |
| 4,745,747 | 5/1988 | Krausse et al. | 60/452 |

FOREIGN PATENT DOCUMENTS

| | | | |
|---|---|---|---|
| 3629638 | 3/1987 | Fed. Rep. of Germany | 417/222 |
| 154501 | 9/1982 | Japan | 60/452 |
| 154502 | 9/1982 | Japan | 60/452 |
| 167501 | 10/1982 | Japan | 60/445 |

*Primary Examiner*—Edward K. Look
*Assistant Examiner*—George Kapsalas
*Attorney, Agent, or Firm*—Webb, Burden, Ziesenheim & Webb

[57] ABSTRACT

A hydraulic switching system has an adjustable delivery volume pump connected to a pump regulating unit that is controlled by a load-sensing regulator. The load-sensing regulator is connected to a control pressure line that carries the maximum hydraulic energy consumer pressure required by at least one hydraulic energy consumer. The hydraulic energy consumer connected to the pump is controlled by a multiway valve having a given adjustment path. In order to increase the fine-controllability of the hydraulic energy consumer when desired, a pressure-compensated flow control valve which is located in the control pressure line is switched in and out of the system.

6 Claims, 2 Drawing Sheets

LOAD-SENSING VARIABLE DISPLACEMENT PUMP CONTROLLER WITH ADJUSTABLE PRESSURE-COMPENSATED FLOW CONTROL VALVE IN FEEDBACK PATH

BACKGROUND OF THE INVENTION

1. Field of the Invention

The invention concerns a hydraulic switching system with an adjustable hydraulic pump in operative connection with at least one hydraulic energy consumer. A multiway valve is connected to the pump and to the hydraulic energy consumer. A pump regulating unit that can be loaded with pump pressure through a load-sensing regulator is connected to a control pressure line that is also connected with the hydraulic energy consumer.

Such a switching arrangement is known as load-sensing regulation. Load-sensing regulation induces delivery volume adjustment of the pump as a function of the hydraulic energy required by the hydraulic energy consumer. Thus, only the amount of hydraulic fluid actually required is delivered by the pump thereby avoiding unnecessary by-pass and throttling losses. If a hydraulic energy consumer is not actuated because the multiway valve assigned to it is in the zero or blocking position, the pump delivers only waste oil and is in a setting with only a small delivery volume, in which case the magnitude of the delivery pressure is determined by a governor spring that acts on a load-sensing regulator. The load-sensing regulator is a two-position/three-way valve having two control pressure chambers. One control pressure chamber is loaded by pump pressure and the opposite chamber is loaded by the pressure of the hydraulic energy consumer and by a governor spring which, for example, is designed so that the spring force coming from it corresponds to a pressure of 20 bar.

So long as no hydraulic energy consumer is actuated and the control pistons inside of the multiway valves assigned to the hydraulic energy consumers are in the zero position, the pump delivers only enough oil to maintain the pump pressure acting on the load-sensing regulator in equilibrium with the force of the spring that is acting on the opposite side of the load-sensing regulator.

By moving the control piston in a multiway valve located upstream of a hydraulic energy consumer, a connection is produced from the pump to the consumer so that the pump pressure is provided to the consumer. The port opened in the multiway valve through the movement of the control piston acts as a metering throttle. At the same time, the pressure at the hydraulic energy consumer, i.e., the pressure in the line between the multiway valve and the consumer loads the spring side of the load-sensing regulator through a control pressure line, so that the pump receives a signal to increase the delivery volume and thus the pump pressure increases. The hydraulic energy consumer is then set in motion and a pressure gradient, $\Delta p$, is produced at the metering throttle. Equilibrium is established in the system if the pressure gradient, $\Delta p$, in the multiway valve matches the spring pretensioning in the load-sensing regulator.

The pump delivery is thus automatically adapted to the pressure required. The multiway valve or its control piston for the hydraulic energy consumer is actuated through a hand lever, the adjustment path of which is proportional to the amount of hydraulic fluid reaching the hydraulic energy consumer, in which case the pressure gradient in the multiway valve always remains constant.

This system will function with a plurality of hydraulic energy consumers and load-sensing regulation as disclosed in U.S. Pat. No. 4,617,854 in which a pump loads a plurality of hydraulic energy consumers. A multiway valve with a built-in quantity regulator is located upstream of each consumer. An additional valve acting as a pressure regulator is built into the lines between the pump and the multiway valves. The pressure regulator control pressure chamber loading in the closing direction is created by the pressure in front of the multiway valve and its control pressure chamber loading in the opening direction is created by the pressure between the multiway valve and the hydraulic energy consumer inlet. An additional control pressure chamber acting in the closing direction is loaded by the pressure of the hydraulic energy consumer having the highest pressure and an additional control pressure chamber acting in the opening direction is loaded with the pressure in the delivery line from the pump.

The multiway valves with built-in quantity regulators distribute the pump stream load independently in relation to the throttle openings at the control piston so long as the stream delivered by the pump corresponds to the sum of the streams received by all of the consumers. If the sum of the consumer streams exceeds the maximum delivery stream of the pump, the maximum delivery stream is distributed to the consumers in the ratio in which the multiway valves assigned to the individual hydraulic energy consumers are opened.

When this system is used on dredges, for example, the path line of a dredge grab bucket produced by two simultaneously actuated operating cylinders is maintained and the rate with which the path line is traversed is reduced. A relatively large number of hydraulic energy consumers can be supplied with any amount of hydraulic fluid with no difficulty, in which case the working speed is substantially increased if all of the consumers are not simultaneously loaded.

A high working speed is, however, not desired in all of the working ranges of a dredge. It is necessary, especially in restricted space conditions, to actuate the hand levers connected with the multiway valves of the individual hydraulic energy consumers very carefully and not move them too vigorously. However, because only a limited adjustment path is available and a very great increase in performance or speed can be achieved within this adjustment path, a precise and delicate adjustment is very difficult and requires considerable concentration and experience by the dredge operator.

SUMMARY OF THE INVENTION

The invention improves the fine-control ability of hydraulic energy consumers with full functioning ability of the load-sensing regulation by simple means. This is achieved according to the invention by locating a pressure-compensated flow control valve in the control pressure line.

The pressure-compensated flowcontrol valve acts as a pretensioning valve that insures that the pressure gradient, $\Delta p$, in the multiway valves is reduced by a certain amount because a certain pretensioning pressure is present in the control pressure line between the multiway valves and the pressure-compensated flow control valve. The spring side of the load-sensing regulator is thus loaded with the hydraulic energy consumer pressure reduced by the pretensioning pressure which shifts the equilibrium at the load-sensing regulator in favor of the control pressure chamber which is loaded by the pump pressure because the force exerted by the pretensioning spring on the opposite control pressure chamber remains unchanged. The delivery volume of the pump is thus reduced by the modified equilibrium conditions at the load-sensing regulator via the circuit arrangement of the system. The amount of hydraulic fluid and the performance that can be provided are thus reduced for each hydraulic energy consumer. The adjustment path of the hand lever remains the same, however, so that the fine-controllability of each individual hydraulic energy consumer is increased. For example, an appropriate selection of the pressure-compensated flow control valve permits half the amount of hydraulic fluid to be controlled over the entire adjustment path of the hand lever.

Because fine work in dredging is generally done at low pressures and with small amounts of hydraulic fluid, the decrease in the pressure gradient, $\Delta p$, in the multiway valves is advantageous because of the associated reduction in power loss. If additional hydraulic energy consumers are switched in during the synchronous control of several consumers, it does not result in a decrease in the travel speed so long as the pump capacity is not exhausted.

A system built with such switching arrangements for limiting the capacity of the hydraulic pump is generally designed as an instantaneous limitation. The maximum torque in the diesel engines ordinarily used for driving the pumps is higher at lower speeds than at the rated rpm at which the maximum capacity is attained. Because the maximum capacity is not required in the fine-control range, i.e., with the pressure-compensated flow control valve switched in, and the instantaneous limitation still functions, the speed of the engine can be reduced and the degree of loading will also be reduced. The fuel consumption and engine noise emission are also reduced.

In an advantageous embodiment of the invention, the pressure-compensated flow control valve can have a mechanical regulating device that is adjustable from the driver's seat of the dredge, by which the characteristics of the pressure-compensated flow control valve and thus the fine-controllability of the hydraulic energy consumers can be adapted to prevailing working requirements. It is favorable if such an adaptation can be facilitated by an electric adjusting device, e.g., by a regulating magnet and a potentiometer.

The pressure-compensated flow control valve can also have a fixed setting and be made to engage through a parallel-switched valve that can be switched in and out electrically. This is advantageous if the environmental conditions in which fine control is required are known.

Further features and other objects and advantages of the invention will become clear from the following description of the preferred embodiments made with reference to the drawings wherein like reference numerals describe like parts in which:

DESCRIPTION OF THE PREFERRED EMBODIMENTS

Figure 1:
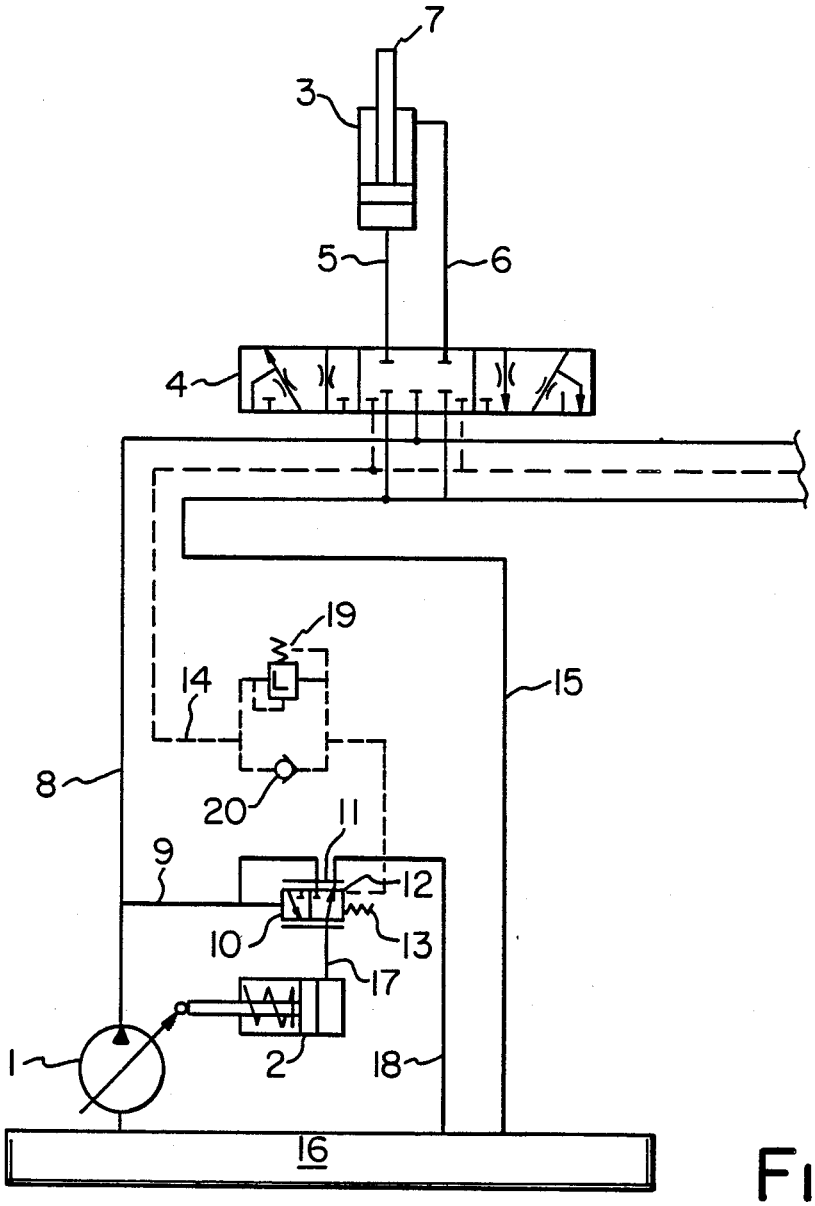
FIG. 1 shows a hydraulic switching system according to the invention which includes a pressure-compensated flow control valve.

FIG. 1 of the drawings shows an adjustable hydraulic pump 1 having a pump regulating unit 2 supplying a hydraulic energy consumer which is shown by way of example as a double-acting operating cylinder 3. A multiway valve 4 is located upstream of the operating cylinder 3 and is operatively connected with two feed and drain lines 5 and 6. A drain line 15 from the multiway valve 4 is connected with a hydraulic fluid reservoir 16. As shown, the multiway valve 4 is in the shut-off position, such that a movement of the operating cylinder piston and piston rod 7 cannot take place. A line 8 carrying the pump output pressure leads from the pump 1 to the multiway valve 4. A branch line 9 leads from line 8 to the control pressure chamber 10 of a load-sensing regulator 11 which is a two-position/three-way valve. On the side opposite control pressure chamber 10 of load-sensing regulator 11, there is an opposite-acting control pressure chamber 12, which is acted upon by a spring 13. Pressure chamber 12 empties into either control pressure lines 14, which leads to the multiway valve 4 or into a drain line 18 which is connected with the hydraulic fluid reservoir 16. The lines 8, 14 and 15 can also lead to additional hydraulic energy consumers (not shown), for example, additional operating cylinders; to the slewing gear of a dredge or to a dredge bucket. These lines are shown in FIG. 1 of the drawings as broken off.

A line 17 that can be loaded with pump outlet pressure leads from load-sensing regulator 11 to the pump regulating unit 2. The line 17 is connected with the branch line 9 in one position of the load-sensing regulator 11 and in another position is connected to a drain line 18 which is connected to the reservoir 16.

A pressure-compensated flow control valve 19 is located in the control pressure line 14 between the load-sensing regulator 11 and the multiway valve 4. There is a check valve 20 in a by-pass line for pressure-compensated flow control valve 19. This arrangement is a pressure-compensated flow control valve with bypass. The valve 19 performs the functions already described herein, i.e., it shifts the equilibrium conditions at the load-sensing regulator 11 by reducing the pressure gradient, $\Delta p$, in the multiway valve 4 and thus increases the fine-controllability of the hydraulic energy consumer while the adjustment path of a hand lever (not shown) for the multiway valve 4 remains in the same position.

Figure 2:
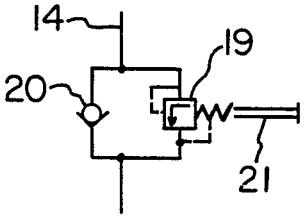
FIG. 2 shows an embodiment of the pressure-compensated flow control valve.

FIG. 2 of the drawings shows an embodiment of the pressure-compensated flow control valve 19 wherein a mechanical adjusting mechanism 21 is used to adjust the pretensioning pressure. This adjustment can be made by the equipment operator from the cab.

Figure 3:
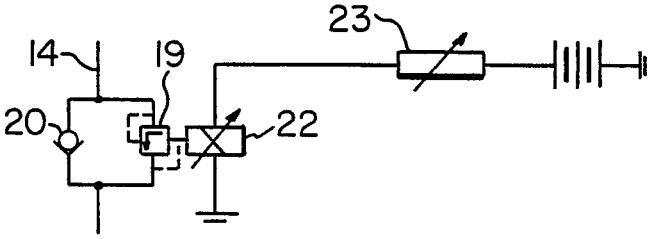
FIG. 3 shows a second embodiment of the pressure-compensated flow control valve.

An electric adjusting arrangement for pressure-compensated flow control valve 19 is shown in FIG. 3 of the drawings. In this embodiment, a regulating magnet 22 is connected to the stop valve 19 and a potentiometer 23 controls the regulating magnet.

The arrangements shown in FIGS. 2 and 3 of the drawings are adjustable pressure-compensated flow control valves with bypass.

Figure 4:
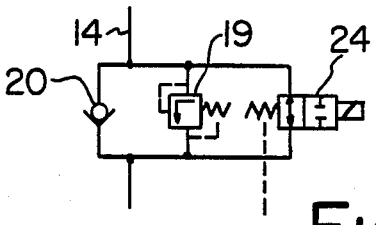
FIG. 4 shows a third embodiment of the pressure-compensated flow control valve.

In the embodiment of the pressure-compensated flow control valve shown in FIG. 4 of the drawings, the valve 19 can be switched in or out of the system by an electrically controlled blocking valve 24 which is located in a by-pass line for the valve. This arrangement is a pressure-compensated flow control valve with bypass.

Figure 5:
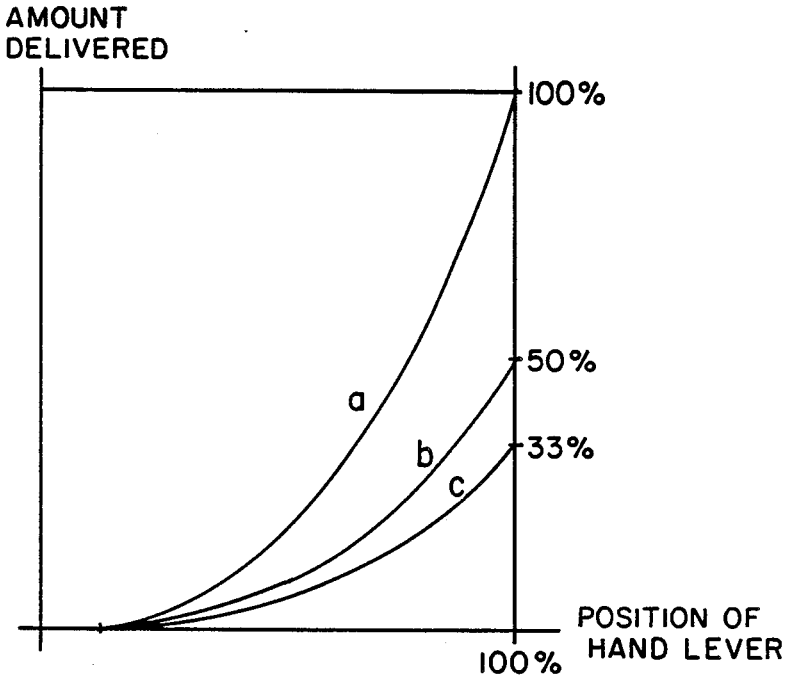
FIG. 5 is a graph showing delivery quantities at various hand lever settings.

The ratio of the adjustment path of a hand lever to the delivery quantity from the pump 1 is plotted in percentages in FIG. 5 of the drawings with the hand lever adjustment path as the abscissa and the amount of flow delivered as the ordinate. Curve a shows the amount delivered by the pump 1 when the pressure-compensated flow control valve 19 is not switched in the system. With the complete travel of a hand lever, corresponding to 100%, the maximum possible amount of 100% of the output of pump 1 is also delivered, i.e., the pump 1 is set to its maximum possible delivery volume. The adjustable pressure gradient, $\Delta p$, is 20 bar, for example, and pretensioning is zero bar.

Curve b shows an improved fine-controllability of the hydraulic energy consumers wherein a 100% hand lever adjustment path provides a delivery volume of only 50%. The pressure gradient, $\Delta p$, in the multiway valve 4 is 5 bar here and the pretensioning is 15 bar. Curve c shows a further improved fine-controllability, wherein a delivery volume of 33% results from a 100% hand lever adjustment, e.g., at a pressure gradient, $\Delta p$, in the multiway valve 4 of 2.25 bar, the pretensioning is 17.75 bar.

Having thus described the invention with the detail and particularity required by the Patent Laws, what is desired and claimed to be protected by Letters Patent is set forth in the following claims.

We claim:

1. In a hydraulic switching system having a hydraulic pump with an adjustable delivery volume, at least one hydraulic energy consumer, a multiway valve connected to said hydraulic energy consumer, a pump regulating unit loaded with pump outlet pressure, a load-sensing regulator connected to said pump regulating unit and a control pressure line connected to said multiway valve to be loaded with pressure by said hydraulic energy consumer, the improvement comprising pressure-compensated flow control valve means operatively connected in said control pressure line between said multiway valve and said load-sensing regulator.

2. The hydraulic switching system set forth in claim 1, wherein said pressure-compensated flow control valve means is an adjustable pressure-compensated flow control valve with bypass wherein said flow control valve is adjusted by a mechanical adjusting mechanism to activate and deactivate said pressure-compensated flow control valve means.

3. The hydraulic switching system set forth in claim 1, wherein said pressure-compensated flow control valve means is a pressure-compensated flow control valve with bypass wherein said flow control valve is adjusted by an electrical adjusting means to activate and deactivate said pressure-compensated flow control valve means.

4. The hydraulic switching system set forth in claim 3, wherein said electrical adjusting means is a magnet and a potentiometer connected to said magnet to control said magnet.

5. The hydraulic switching system set forth in claim 3, wherein said electrical adjusting means is an electrically controlled valve.

6. The hydraulic switching system set forth in claim 1, wherein said pressure-compensated flow control valve means is a pressure-compensated flow control valve with bypass which is a valve that can be switched in or out of said system by an electrically controlled blocking valve.

* * * * *